United States Patent [19]

Lynn-Jones et al.

[11] 4,295,315

[45] Oct. 20, 1981

[54] EXPANSION JOINT COVER

[75] Inventors: David M. Lynn-Jones, Muncy, Pa.; R. Gordon Stewart, Georgetown, Canada

[73] Assignee: Construction Specialties, Inc., Cranford, N.J.

[21] Appl. No.: 953,775

[22] Filed: Oct. 23, 1978

[51] Int. Cl.[3] ..... E04B 1/68

[52] U.S. Cl. ..... 52/573; 52/402; 404/69; 14/16.5

[58] Field of Search ..... 52/573, 393, 402, 403; 404/64, 65, 67, 69, 68, 47; 14/16.5

[56] References Cited

U.S. PATENT DOCUMENTS

| | | | |
|---|---|---|---|
| 3,165,986 | 1/1965 | Hirst et al. | 404/47 |
| 3,390,501 | 7/1968 | Driggers | 404/47 X |
| 3,677,145 | 7/1972 | Wattiez | 404/47 |
| 3,918,824 | 11/1975 | Bowman | 404/65 X |

*Primary Examiner*—Carl D. Friedman

*Attorney, Agent, or Firm*—Brumbaugh, Graves, Donohue & Raymond

[57] ABSTRACT

An expansion joint cover comprises a pair of elongated rigid frame members, each of which includes a generally vertical, longitudinally continuous wall portion and a multiplicity of longitudinally spaced-apart, substantially horizontal plate-like tongues supported in cantilevered relation from the vertical wall portion at locations spaced from the upper edge of the wall portion and in longitudinal alignment. The longitudinal spacings between adjacent tongues of each frame member are not less than the widths of the tongues of the other frame member such that in the cover as installed in the expansion gap the tongues of each frame member project into the spaces between the tongues of the other frame member, and a generally longitudinally continuous bridge is formed by an intervening of the tongues of each of the frame members between the tongues of the other. A resiliently compressible sealing element is supported by the tongues and is retained on the frame members by reception of the edges in cavities on the frame members.

3 Claims, 11 Drawing Figures

EXPANSION JOINT COVER

BACKGROUND OF THE INVENTION

This invention relates to expansion joint covers and, in particular, to expansion joint covers for use in bridging spaces between adjacent floor sections or between a floor and wall on opposite sides of an expansion gap.

The covers used at expansion gaps between sections of buildings serve several functions. Floor-to-floor covers ordinarily must be constructed to carry the loads of persons or objects moving across the gap. Virtually all floor-to-floor and many floor-to-wall expansion joint covers, therefore, have a rigid bridging member that is supported by rigid frame members in a manner that permits relative movement of the frame members as the frame members move with the building sections upon expansion and contraction of the building. In many cases, one or both of the frame members that are anchored to the respective sections are constructed in two parts to permit installation of the sealing element in the final stages of assembly of the cover. Most floor expansion joint covers are also designed to provide a seal against air leakage, and in some cases liquid leakage, and most expansion joint covers have one or more sealing elements for that purpose. The design objectives of providing load-supporting capability, durability and effective sealing have tended to result in complicated, expensive designs requiring several component parts and a considerable amount of field work for installation. Many existing joint cover designs have failed to fulfill adequately all of the functions they were intended to fulfill, effective sealing and durability being the attributes most often lacking.

SUMMARY OF THE INVENTION

There are provided, in accordance with the present invention, expansion joint covers for bridging the space between adjacent building sections on opposite sides of an expansion gap which are durable, easy to install and maintain, require a minimum number of different components, and provide highly effective sealing. More particularly, an expansion joint cover, according to the present invention, comprises a pair of elongated rigid frame members adapted to be anchored to the respective sections on either side of an expansion gap in a building. Each of the frame members includes a generally vertical wall portion and a multiplicity of longitudinally spaced-apart, substantially horizontal plate-like tongues supported in cantilevered relation by the vertical wall portion at locations spaced from the upper edge of the wall portion and in longitudinal alignment. The longitudinal spacings between adjacent tongues of each frame member are not less than the widths of the tongues of the other frame member so that, in the cover as installed in the expansion gap, the tongues of each frame member project into the spaces between the tongues of the other frame member. The result is a generally longitudinally continuous bridge formed by the intervening of the tongues of each of the frame members between the tongues of the other. A suitable resiliently compressible sealing element is appropriately engaged with the respective frame members in sealing relation and is supported by the tongues of the frame members. Preferably, the spacings between the adjacent tongues of each frame member are substantially greater than the widths of the tongues of the other frame member so that when the tongues of each intervene between tongues of the other, there are residual longitudinal spaces which permit relative longitudinal movements of the frame members upon corresponding movements of the building sections on either side of the gap.

The frame members are preferably aluminum extrusions and are extruded with the tongues integrally united with the vertical wall portion, the tongues being vestigial segments of a longitudinally continuous flange of the extrusion from which pieces corresponding to the spaces between the tongues have been removed.

Each frame member of an expansion joint seal embodying the present invention also includes a longitudinally continuous flange extending generally inwardly from the vertical wall portion toward the expansion gap and located some distance above the tongues. The flange defines with the tongues a longitudinally inwardly open cavity which receives portions along the edges of the sealing element and retains the sealing element in place. The cavity may be undercut at the top and bottom to receive beads along the edges of the sealing element, or the cavities may be essentially rectangular in cross section, in which case the sealing element is retained merely by reception of portions of relatively substantial widths along each side of the sealing element in the cavity, preferably under compression of the sealing element, to hold it securely in place.

The sealing element includes a multiplicity of longitudinally continuous, side-by-side hollow cells defined, in cross section, by transversely spaced-apart generally vertical walls and vertically spaced-apart generally transverse walls interconnecting the top and bottom edges of adjacent vertical walls. At least one of the transverse walls of each cell has angularly related segments which fold into the space within the cell as the sealing element is laterally compressed upon movement of the building sections toward each other. For example, the top transverse walls in every other cell along the width of the element may comprise angularly related segments, the bottom transverse walls of cells being essentially straight, and the bottom walls of the remaining cells have angularly related segments while the top walls of those segments are substantially straight. Alternatively, both the top and bottom transverse walls of each cell may comprise angularly related segments. It is desirable that the upper edges of the cells of the sealing elements in the gap between the inward extremities of the upper flanges of the frame members be generally flush with the upper surfaces of the flanges.

As a preferred, though not essential, feature of the invention, the transverse dimensional relationships between the cavities of the frame members as installed in the joint and the transverse dimensional relationships between the edges of the sealing element in its relaxed condition are such that the upper transverse portions are always under a greater compression or a lower tension than are the lower transverse wall portions when the sealing element is in place. This insures that there is always a downward force imparted on the center part of the sealing element to insure that it remains in place and lies flat within the gap rather than humping, particularly when the expansion gap narrows and the seal is placed under relatively high compression and tends to be squeezed out of the space between the vertical walls of the frame members.

When the expansion joint seal is used in an exterior installation, it preferably includes an elongated waterstop of water-impermeable flexible material which extends transversely under the frame members and the sealing element and terminates laterally outwardly of the outward lateral extremities of the frame members. The waterstop includes a trough portion which is received in the expansion gap for collecting and draining off any water that leaks past the sealing element and upwardly turned, longitudinally continuous flanges on each side located outwardly of the outward lateral extremities of the frame member, thus to insure collection of all water leakage. It is important that the stop extend continuously for substantial distances on either side of each joint between lengths of frame members; such joints are prone to leakage, and any water that intrudes at the crack between lengths of the frame members will be captured by the flexible stop underlying the remainder of the expansion joint and seal.

For a better understanding of the invention, reference may be made to the following description of exemplary embodiments, taken in conjunction with figures in the accompanying drawings.

DESCRIPTION OF EXEMPLARY EMBODIMENTS

Figure 1:
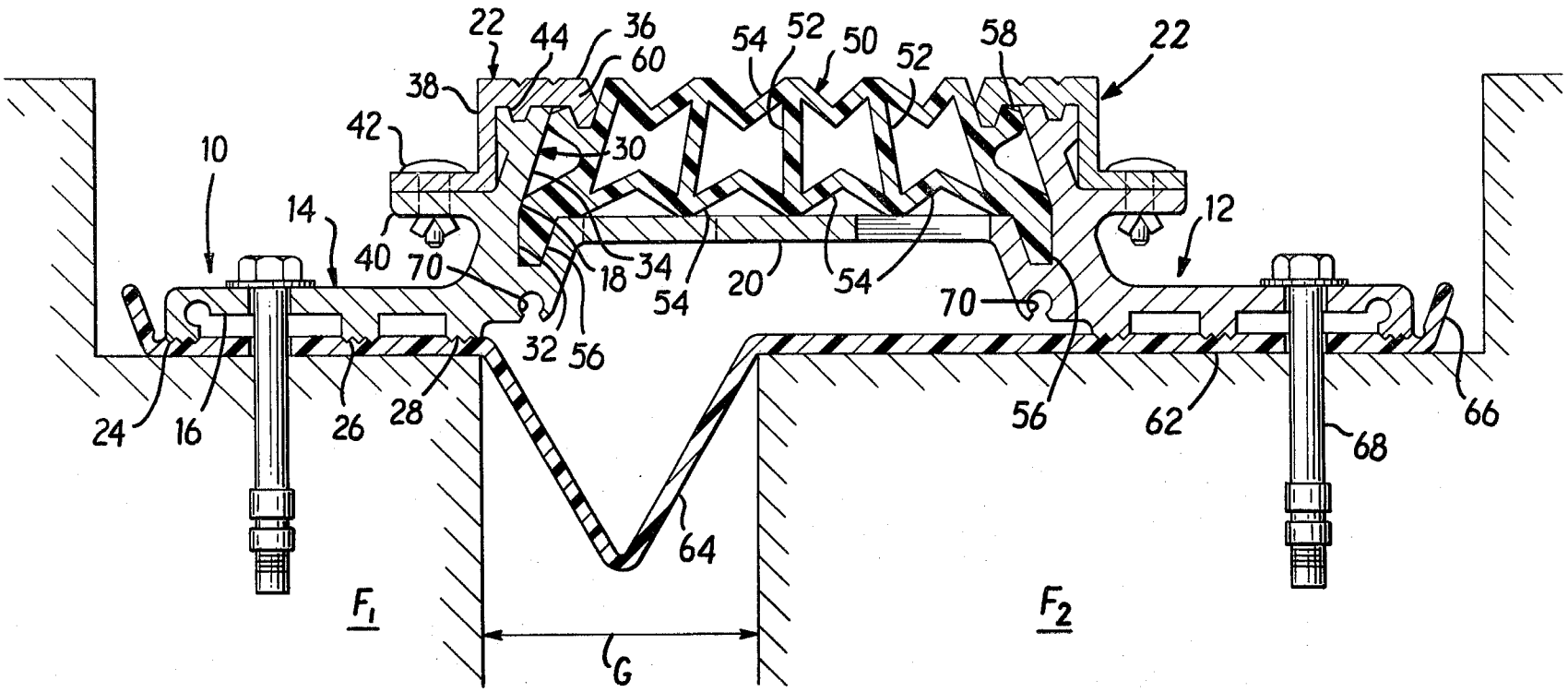
FIG. 1 is a transverse cross-sectional view of one embodiment of the invention.

The embodiment shown in FIGS. 1 through 4 of the drawings is a floor-to-floor expansion joint cover intended for exterior use and comprises a pair of frame members 10 and 12 which are, preferably, identical to each other and are merely turned end for end relative to each other for use on either side of an expansion gap G between floor sections $F_1$ and $F_2$ on either side of the gap. Each frame member 10 (or 12) is composed of two pieces, namely, a main piece 14 consisting of a base or mounting flange 16, a generally vertical wall portion 18, a series of plate-like horizontally spaced-apart tongues 20, and a generally Z-shaped seal retainer 22. The main part 14 and retainer 22 are preferably aluminum extrusions and are, therefore, of uniform cross-section along their length except for the fact that the tongues 20 are vestigial segments of a longitudinally continuous flange from which pieces are cut to leave the tongues, as described in a little more detail below.

The mounting flange 16 of each frame member 10 or 12 includes, in cross-section, three laterally spaced-apart ribs 24, 26 and 28, each of which is serrated along its lower edge (as shown) and provides the supporting or bearing surfaces by which the cover is supported on the floor sections. The ribs 24, 26 and 28 also define therebetween recesses in the underside of the mounting flange 16 which may accommodate shims, if required, above the waterstop (hereinafter described). By providing for shimming above the waterstop, rather than below it, the integrity of the seal between the waterstop and the floor need not be impaired where shimming is required. The vertical wall portion 18 is shaped in cross-section to provide the lower part of a cavity 30, the cavity having a groove or recess 32 which faces upwardly and opens into a part of the cavity defined by an inclined surface 34. The retainer part 22 of the frame members 10 or 12 includes, in cross-section, a generally horizontal flange portion 36 which, as the expansion joint cover is installed in the floor, lies substantially flush with the surface of the floor, and a generally L-shaped mounting flange portion 38, the base leg of which matches a companion horizontal flange 40 on the main part 14 of the frame member and to which the retainer part 22 is secured by drive rivets 42, thereby facilitating field installation. Proper register between the retainer 22 and main part 14 of the frame member is insured by a groove and matching rib, together labelled 44.

Figure 2A:
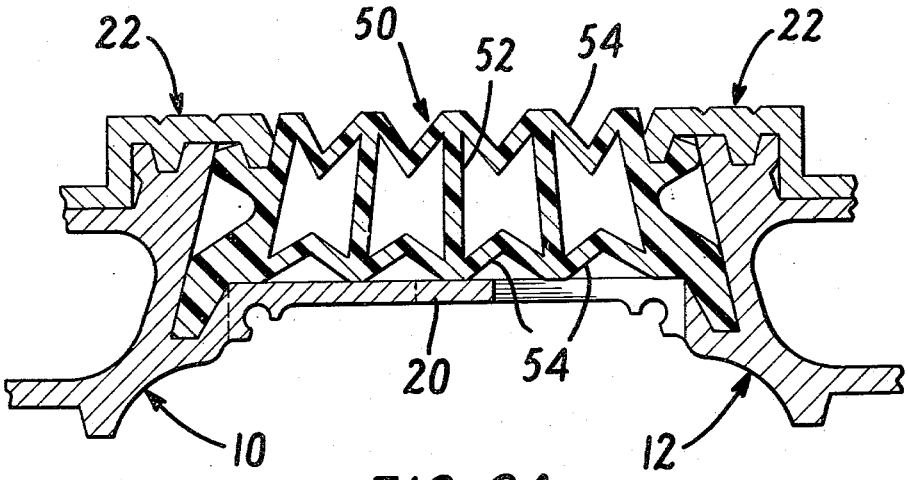
FIG. 2A is a partial cross-sectional view of the embodiment of FIG. 1 showing it at approximately its widest opening.
Figure 2B:
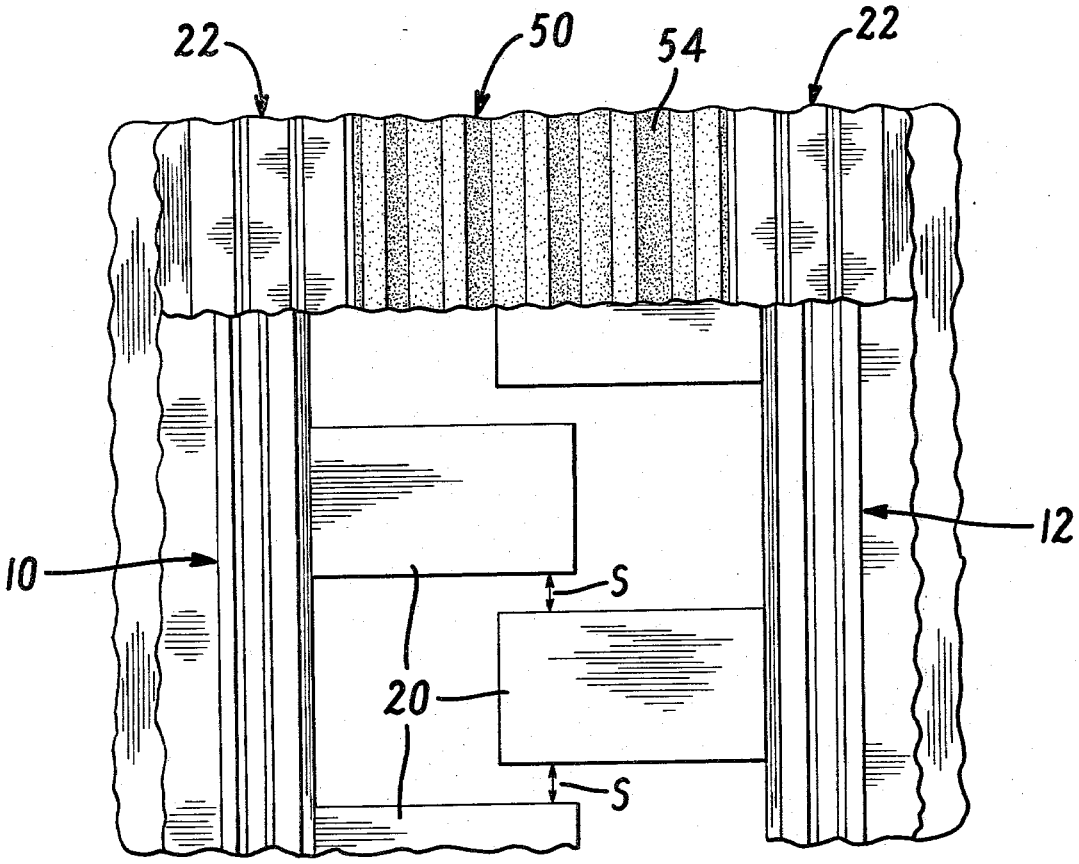
FIG. 2B is a top view of a portion of the expansion joint cover of FIG. 1, also showing it substantially fully open.
Figure 3A:
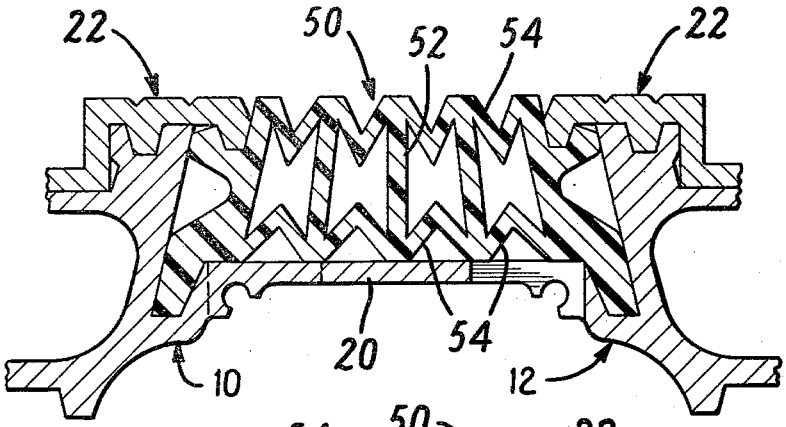
FIG. 3A is a partial cross-sectional view of the embodiment of FIG. 1 showing a generally normal degree of opening.
Figure 3B:
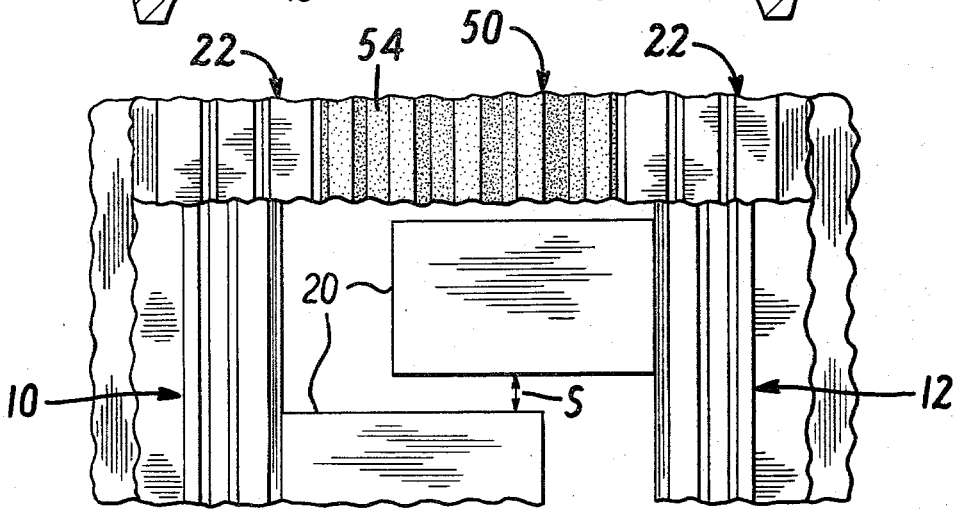
FIG. 3B is a top view of a representative lengthwise section of the joint covers under the same degree of opening as FIG. 3A.
Figure 4A:
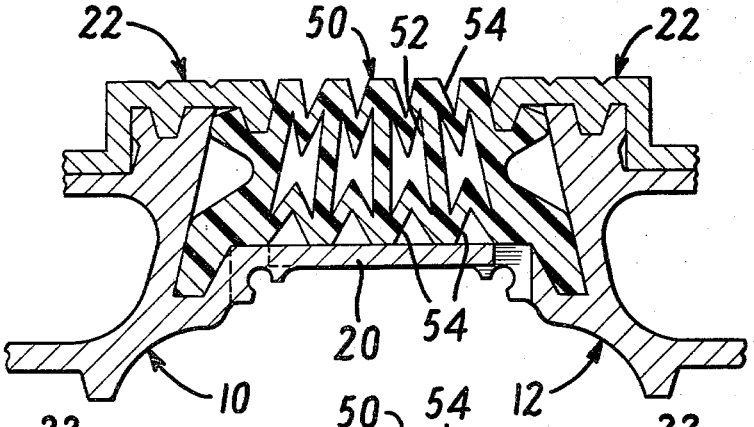
FIG. 4A is a partial cross-sectional view of the embodiment of FIG. 1 showing it essentially fully closed.
Figure 4B:
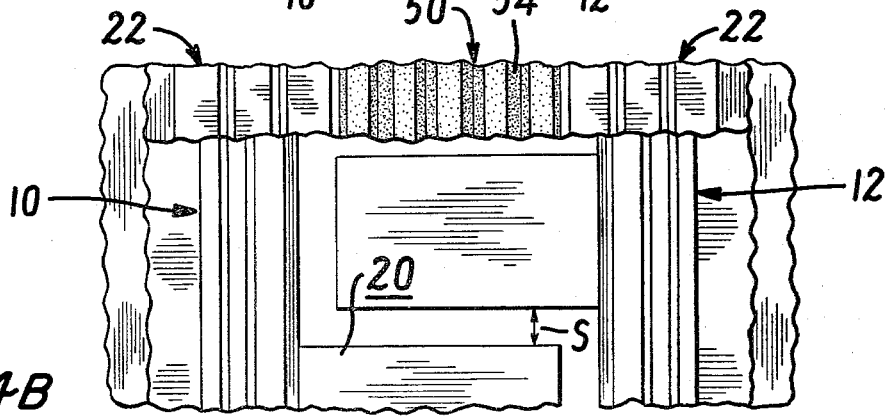
FIG. 4B is a top view of a representative lengthwise section of the embodiment of FIG. 1 in substantially the fully closed position.

As may best be seen in FIGS. 2B, 3B and 4B, the spaces between the tongues 20 of the frame member are somewhat wider than the width of each tongue so that in the cover as installed in the expansion gap the tongues of each frame member intervene between the tongues of the other frame member with residual longitudinal spaces S being provided to allow relative longitudinal movement between the floor sections $F_1$ and $F_2$. Such intervening of the tongues of each frame member into spaces between the other frame member provides a zone or band along generally the center of the expansion joint cover which is essentially continuous except for the small residual spaces S. The widths of that zone or band vary, depending on the relative positions of the floor sections as the structures on either side of the gap expand and contract and thereby close and open the gap (see FIGS. 2 through 4).

Each of the tongues 20 is supported in cantilevered relation by the vertical wall section of the frame member, and therefore the zone or band in the zones where the tongues of each frame member intervene in the spaces between the tongues of the other frame member constitutes a bridging structure extending generally continuously along the medial portion of the length of the cover above the expansion gap G.

The space above the bridging structure provided by the mutually intervening tongues and between the vertical wall portions 18 of the frame members 10 and 12 is filled and sealed by a sealing element 50 which consists of a series of longitudinally continuous, side-by-side cells. Each cell consists of a pair of laterally spaced-apart generally vertical walls 52 and a pair of vertically spaced-apart transverse walls 54. The transverse walls have two angularly related sections that fold inwardly into the cell opening as the joint closes (see FIG. 4A), allowing the sealing element to collapse internally without humping in the center. The sealing element is made of a durable elastometer, preferably neoprene having a hardness in the range of about 70 to 90, Shore "A" scale.

A lower bead 56 (FIG. 1) along each side of the sealing element is received in the groove 32 in the bottom portion of the cavity 30, and an upper bead 58 along each side of the sealing element is received in an undercut groove defined between the upper end of the vertical portion of each frame member and a lip 60 which turns down from the upper flange 36 of the retainer 22. The undercut configuration of the cavity 30 in the vertical wall portion of each frame member insures firm retention of the sealing element in place on the respective frame members at all degrees of separation at the expansion gap. As will be appreciated, the beads 56 and 58 are also designed to permit the upper beads 58 to nest within the lower beads 56 so that the sealing element can be rolled lengthwise on itself for ease of delivery.

The sealing element is designed to be installed in a generally relaxed condition at about the mid-point of the range of movement of the gap (FIGS. 3A and 3B), extends under tension when the expansion gap expands (FIGS. 2A and 2B) and closes under compression when the gap closes (FIGS. 4A and 4B). However, the transverse dimensions of the sealing element relative to the transverse dimensions between the frame members, and in particular the converging profiles of the inclined surfaces 34, are such that the upper part of the sealing element is placed initially under compression, while the lower portion is placed in tension, at about the mid-point of joint movement, thus to generate a downward force on the center part of the sealing element which tends to hold it down flat against the bridge structure under all degrees of compression of the sealing element. This is accomplished by initially forming the sealing element to a shape somewhat different from the shape in which it is installed and as it is shown in the figures of the drawings; specifically, the initial shape of the sealing element is such that the vertical wall portions 52 in the seal in its relaxed, as-formed condition lie essentially parallel to each other.

When the sealing element is installed, the upper portion is compressed, and the shape is altered or deformed throughout its cross-section. The higher compression pre-load in the top portion of the seal and the resulting downward force imposed on the sealing element keeps it from humping up in the middle, particularly when the joint is subject to the higher ranges of compression as the gap closes (see FIGS. 4A and B). The inward folding of the walls into the openings of the cell facilitates the retention of a generally continuous, level surface across the expansion gap between the floor sections. At all intersections the sealing element is either shop or field mitered and vulcanized to ensure a continuous seal.

The expansion joint cover of FIGS. 1 to 4 is installed in blocked out areas formed in the reinforced concrete on either side of the joint when the concrete sections are poured or in cut-away sections of existing floor structure. A sealing strip or waterstop 62 of a water-impermeable durable flexible material such as neoprene is installed under the cover. The waterstop 62 includes a trough or gutter 64 positioned to be received within the gap G and is of an overall width such that it underlies the entire frame and sealing element structure, the edges of the waterstop 62 being located beyond the laterally outward extremities of the frame members 10 and 12. An upturned flange or lip 66 along each edge of the waterstop 62 insures collection of any water that leaks through the seal and directs it toward the center of the joint where it may evaporate or be drained off. To be most effective, the waterstop 62 should extend continuously for a substantial distance on either side of the joint and should be bonded to the concrete floor on both sides of the joint with a mastic type sealant. The small cracks that necessarily exist where the cover sections meet are prone to water leakage. Whenever the floor joints terminate, as at walls or curbs for example, the waterstop 62 is preferably shop or field mitred and the ends bonded together to maintain the continuity of the seal.

The upper surface of each retainer member 22 is serrated lengthwise (see, e.g., FIGS. 2A and 2B) as a precaution against slipping. The region overlying the rivets 42 is left open to allow for a final caulking bead between the vertical leg of the mounting flange 38 and the facing surface of the grout or finished concrete (not shown) commonly poured between the frame 10 (or 12) and the adjacent edge of the concrete floor. This construction greatly facilitates replacement of the sealing element 50 in the event of damage or the like, as the only disassembly required is the removal of the caulking bead and the rivets 42. The replacement work may then be completed quite easily by inserting a new element 50 and re-riveting and re-caulking the retainers 22. It also simplifies the concrete finishing work since the design of the caulking grooves is such that a polyvinylchloride or aluminum filler may be placed in the grooves during the pouring of the finished concrete and thereafter quite easily removed for introduction of the caulking sealant.

The frame members 10 and 12 are suitably anchored to the concrete floor, preferably by expandable anchor bolts 68 and lock washers so that the installation holes in the concrete may be line drilled through the preformed holes in the frame members, thereby eliminating the time consuming marking out required by other types of fasteners. Screw-type bosses 70 (FIG. 1) are provided on the frame members for the purpose of receiving alignment pins at butt joints in the joint cover. The location of these bosses on the floor frame members 10 and 12 is such that they will align with the bosses on the wall-mounted frame members (described hereinafter) as well.

Figure 5:
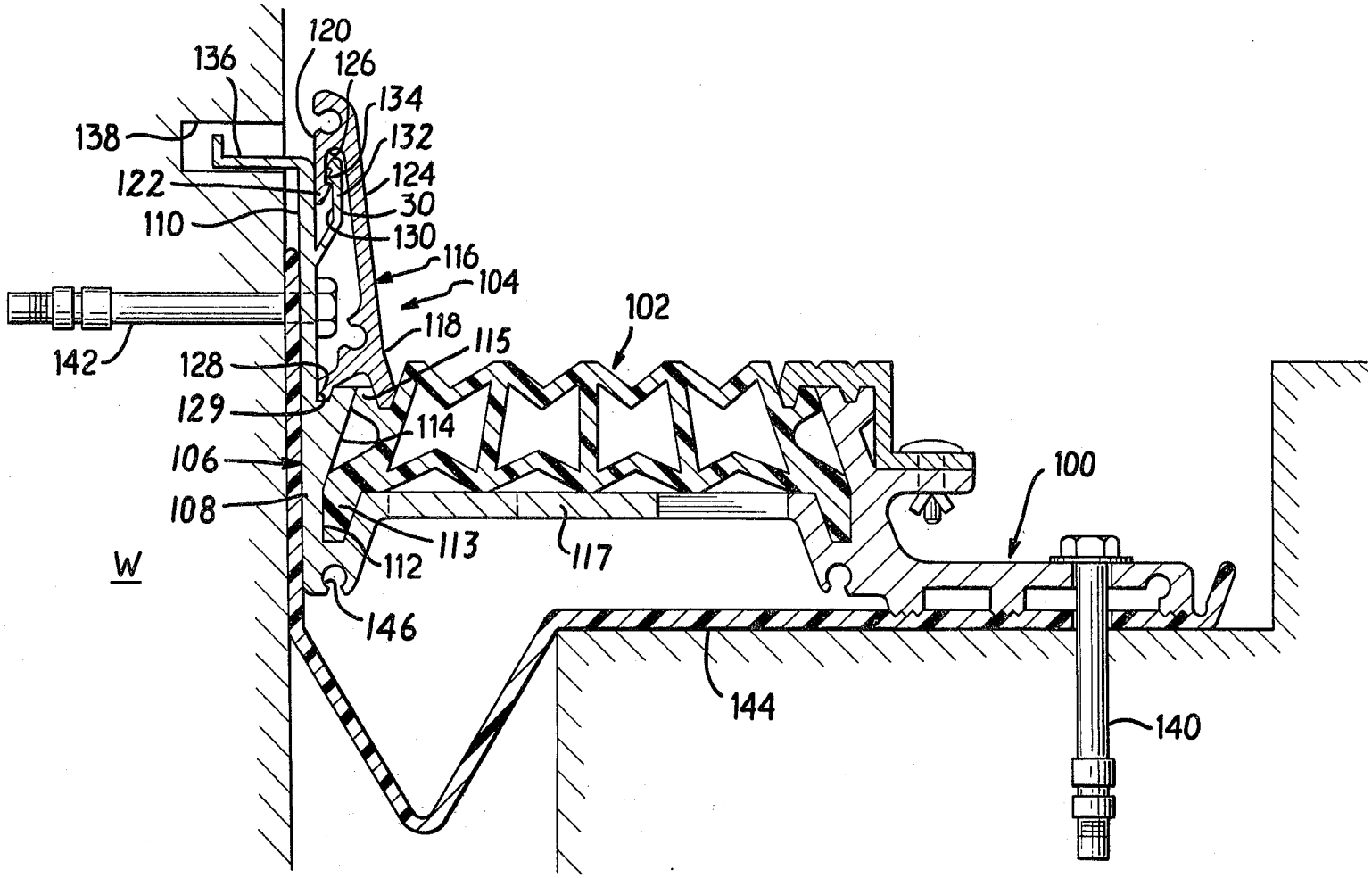
FIG. 5 is an end cross-sectional view of a floor-to-wall expansion joint cover embodying the present invention.

The embodiment shown in FIG. 5 is an expansion joint cover designed for floor-to-wall installations. It includes a frame member 100 and a sealing element 102 which are identical in all respects to the frame members 10 and 12 and the sealing element 50, respectively, of the embodiment shown in FIGS. 1 and 4. The embodiment of FIG. 5 also includes a wall-mounted frame member 104 having a main portion 106 consisting of a vertical wall portion 108 and a mounting portion 110 above the wall portion. The vertical wall portion 108 has an upwardly facing recess or groove 112 which receives the lower bead 113 of the sealing element 102 and defines part of a cavity 114 which receives the edge of the sealing element. A seal retainer component 116 of the wall-mounted frame 104 has a flange 118 at its lower end which defines an undercut part of the cavity 114 for receiving and capturing the upper bead 115 along the edge of the sealing element 102. As in the embodiment of FIGS. 1 and 4, the bottom of the cavity 114 in FIG. 5 is formed by tongues 117 that are cantilevered, in the manner of the tongues 20 in FIG. 1, from the inner wall of the groove 112. The upper end of the retainer component 116 has a downwardly extending flange 120 having an inwardly extending tooth 122 at its lower end and defining with a main vertical part 125 a downwardly open groove 126. The retainer component 116 snaps into locked position on the main component 106 by reception of a lower rib 128 in a matching groove 129 on the main part 106 and by reception and capture of the upper flange 120 in an upwardly open slot 130 defined between the upper part of the mounting portion 110 and a roughly L-shaped flange 132 which projects up from the mounting portion and which has capturing teeth 134 at its upper end that interlock with the tooth 122 on the flange 120 of the retainer component 116.

It should now be apparent that the wall edge of the sealing element 102 is captured in the cavity 114 upon positioning the retainer component 116 somewhat above its final position and then forcing it down into seated and locked position. A right angle terminal flange 136 at the upper end of the mounting portion 110 of the frame 104 extends into a groove 138 cut into or formed in the wall W. The residual spaces in the slot 138 and behind the upper end of the retainer component 116 are filled with a suitable caulking compound to seal the wall frame 104 to the wall, thereby blocking leakage of moisture along the wall surface. Both of the frames 100 and 104 are anchored to the floor and wall by expandable type anchor bolts 140 and 142, respectively.

For purposes of alignement with the floor-mounted frame 100, the wall-mounted frame 106 includes a screw-type boss 146 which is itself located on the frame portion 108 so as to be in alignment with the corresponding boss 70 on the floor frame member 10 as shown in FIG. 1. Accordingly, it will be apparent that a continuous expansion joint cover and seal can be established across the entire width of a floor, notwithstanding that a wall line lies along a part of the length of the expansion joint. Alignment between the floor-mounted frame 110 and the wall-mounted frame 104 at the point of transition from the floor-to-floor structure of FIG. 1 to the floor-to-wall structure of FIG. 5 is accomplished through receipt of an alignement pin (not shown) in the opening of the respective bosses 70 and 146. The sealing element 102 may thus continue without interruption along the entire length of the expansion joint.

Referring again to FIG. 5, a waterstop 144 extends completely under the frame member 100 and part way up the wall under the wall frame member 104. The waterstop 62 as used in the floor-to-floor embodiment shown in FIGS. 1 through 4 of the drawings may be used in the floor-to-wall embodiment, in which cast the part that underlies the wall frame member 104 is merely deformed from the condition of the floor-to-floor installation upon installation of the frame member 104. The function of the waterstop 144 is the same as that of the floor-to-floor type 62. In fact, the waterstop 62 of the floor-to-floor installation may be installed in one continuous length in both floor-to-floor and floor-to-wall joints by partially cutting the waterstop in the transverse direction at the point of transition between the two types of joints. If necessary the gap formed by cutting the waterstop can be sealed by a flat quadrant piece of waterstop material which is bonded to the cut ends of the waterstop.

Figure 6A:
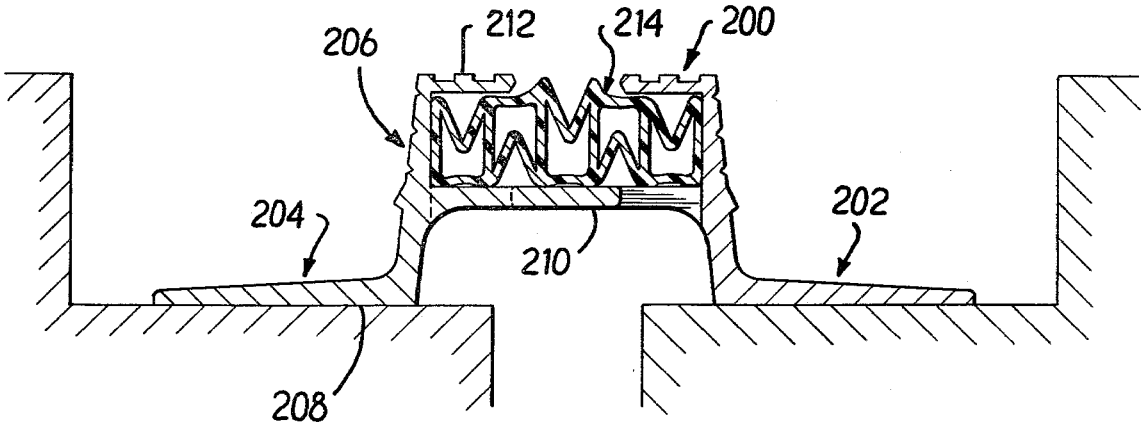
FIGS. 6A, 6B and 6C are cross-sectional views of another embodiment of the invention showing the embodiment in various degrees of opening and closure of the expansion gap.
Figure 6B:
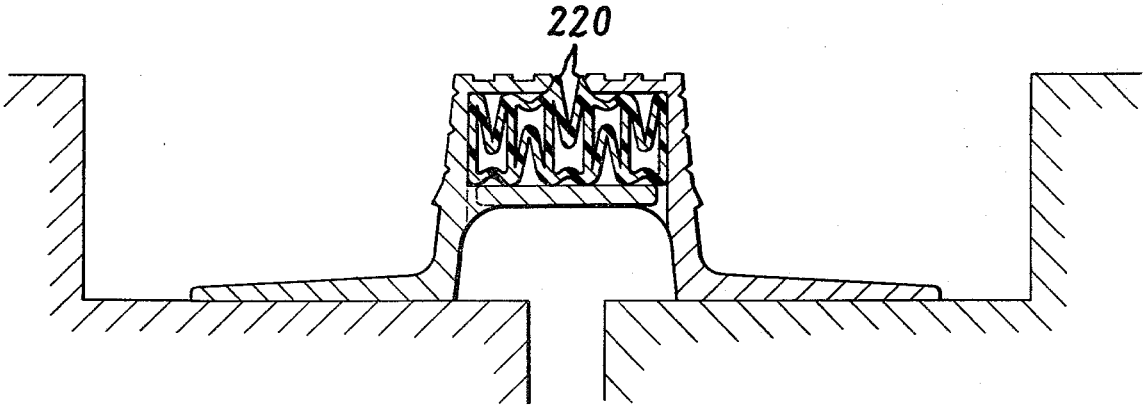
Figure 6C:
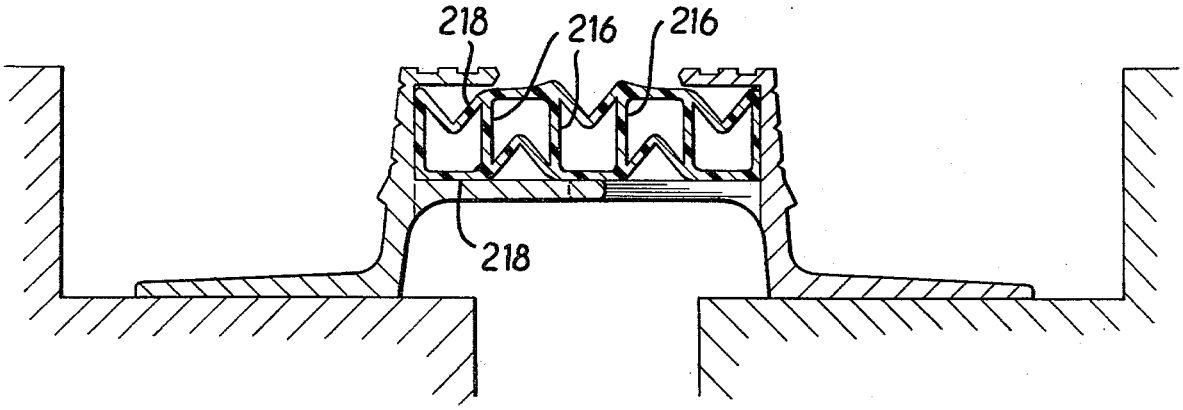

The expansion joint cover 200 shown in FIGS. 6A to 6C is intended for interior use and comprises identical frame members 202 and 204 which are best made by extrusion of aluminum. Each of the frame members includes a vertical wall portion 206, a base or mounting leg 208, a series of longitudinally spaced-apart, plate-like tongues 210 disposed generally horizontally in alignment with each other and cantilevered from near the center of the vertical wall portion, and a longitudinally continuous, horizontal upper flange 212 extending from the upper edge of the vertical wall portion 206 and lying generally contiguous to the finished floor. The upper flange and the tongues define with the upper part of the vertical wall portion a relatively deep cavity opening toward the expansion gap. As with the embodiments described above, the tongues 210 of each frame member 202 or 204 intervene into the spaces between the tongues of the other frame member to provide along generally the center of the cover a substantially continuous zone or band in the nature of a bridge for supporting the center part of a sealing element 214.

The sealing element 214 consists of laterally spaced-apart vertical wall portions 216 and upper and lower transverse wall portions 218 (see FIG. 6C) connecting the upper and lower edges of the vertical wall portions, thus to define a series of side-by-side cells. One of the transverse wall portions of each cell has angularly related segments which fold into the opening of the cell when the expansion gap closes (see FIG. 6B). Smooth, concave beads 220 at the upper ends of the vertical walls of the center cell extend the height of those walls sufficiently to make the upper edges of the center cell generally continuous with the upper surfaces of the flanges 212. The upper transverse wall of the center cell is the generally V-shaped wall of that cell so that it is the wall that folds when the gap closes, thus to maintain contiguity between the upper surfaces of the seal and frame in all positions of the cover.

The sealing element 214 is securely held in place on the frames 202 and 204 by reception of the edges within the deep cavities of the frame members. That retention is assured by installing the sealing element with a precompression at about the mid-point of the range of movement of the floor sections on either side of the expansion gap. To this end, the expansion joint cover is factory assembled with the sealing element in place and is held under compression during shipment and installation by, for example, temporary generally U-shaped clips (not shown) fitted over the top of the cover and along the outsides of the vertical wall portions. In particular, FIG. 6A shows the precompressed assembled position of the joint cover. When the expansion gap opens, the sealing element expands out toward its relaxed, initially-formed shape (FIG. 6C); the precompressed installation ensures retention of the edges of the sealing element within the cavities of the frames throughout the range of expansion and closure of the expansion gap.

We claim:

1. An expansion joint cover for bridging the space between adjacent sections of a building on opposite sides of an expansion gap comprising a pair of elongated extruded rigid frame members adapted to be anchored to the respective sections, each of the frame members including a generally vertical wall portion and a multiplicity of longitudinally spaced apart, substantially horizontal plate-like tongues integral with and supported in cantilevered relation by the vertical wall portion at locations spaced from the upper edge of the wall portion and in longitudinal alignment, each tongue being a vestigial segment of a longitudinally continuous flange from which pieces corresponding to the spaces have been removed, the longitudinal spacings between adjacent tongues of each frame member being not less than the widths of the tongues of the other frame member such that in the cover as installed in the expansion gap the tongues of each frame member project into the spaces between the tongues of the other frame member and a generally longitudinally continuous bridge is formed by an intervening of end portions of the tongues of each of the frame members between end portions of the tongues of the other along the expansion gap, and wherein each frame member includes a longitudinally continuous flange extending generally inwardly from the vertical wall portion toward the expansion gap and spaced apart from and located above the tongues, the flange defining with the tongues a longitudinal inwardly open cavity, and a resiliently compressible sealing element composed of interconnected walls defining hollow longitudinally elongated cells engaging the vertical wall portions of the respective frame members and supported by the tongues, wherein portions along the edges of the sealing element are received and retained in the respective cavities of the frame members, wherein said sealing element includes a multiplicity of longitudinally continuous side by side, generally rectilinear hollow cells defined in cross section by transversally spaced apart generally vertical walls and vertically spaced apart generally transverse walls interconnecting the respective top and bottom edges of adjacent vertical walls, at least one of the transverse walls of each cell having angularly related segments adapted to fold into the space within the cell upon movement of the building sections toward each other tending to close the gap, said transverse walls having angularly related segments being the top walls on every other cell along the width of the element and the bottom walls of the remaining cells, the number of side by side cells of the sealing element being an uneven number not less than five, and the top wall of the center cell having angularly related segments, and wherein the vertical walls defining the center cell extend higher above the tongues than the vertical walls of the remaining cells, the top of the walls of the center cell being generally flush with the upper surface of the flanges of the frame members.

2. An expansion joint cover for bridging the space between adjacent sections of a building on opposite sides of an expansion gap comprising a pair of elongated extruded rigid frame members adapted to be anchored to the respective sections, each of the frame members including a generally vertical wall portion and a multiplicity of longitudinally spaced apart, substantially horizontal plate-like tongues integral with and supported in cantilevered relation by the vertical wall portion at locations spaced from the upper edge of the wall portion and in longitudinal alignment, each tongue being a vestigial segment of a longitudinally continuous flange from which pieces corresponding to the spaces have been removed, the longitudinal spacings between adjacent tongues of each frame member being not less than the widths of the tongues of the other frame members such that in the cover as installed in the expansion gap the tongues of each frame member project into the spaces between the tongues of the other frame member and a generally longitudinally continuous bridge is formed by an intervening of end portions of the tongues of each of the frame members between end portions of the tongues of the other along the expansion gap, and wherein each frame member includes a longitudinally continuous flange extending generally inwardly from the vertical wall portion toward the expansion gap and spaced apart from and located above the tongues, the flange defining with the tongues a longitudinally inwardly open cavity, and a resiliently compressible sealing element composed of interconnected walls defining hollow longitudinally elongated cells engaging the vertical wall portions of the respective frame members and supported by the tongues, wherein portions along the edges of the sealing element are received and retained in the respective cavities of the frame members, wherein the cavity of each frame member is defined in part by longitudinally continuous upper and lower rib portions which extend generally vertically toward each other to define undercuts in the cavities, said generally inwardly extending flange being formed on a member distinct from the remainder of the frame members and securable to the remainder of the frame by fastening means, and wherein the sealing element includes longitudinally continuous beads along the edges which are received in the undercuts for retention of the sealing element by the frame member, wherein the sealing element includes a multiplicity of longitudinally continuous side by side hollow cells defined by transversally spaced apart generally vertical wall portions and vertically spaced apart generally transverse wall portions interconnecting the respective top and bottom edges to the vertical wall portions, at least one of the transverse wall portions of each cell having angularly related segments adapted to fold into the space within the cell upon transverse compression of the sealing element when the expansion gap narrows, wherein the transverse dimensional relationships between the cavities of the frame members as installed in the joint and the transverse dimensional relationships between the beads of the sealing element in its relaxed condition are such that the upper transverse wall portions are always under greater compression or lower tension than are the lower transverse wall portions when the sealing element is in place, thus always to impart a downward force on the center of the sealing element; thereby maintaining the upper transverse wall portion substantially flush with said generally inwardly extending flange portions independent of the relative spacing of the frame members, and including the fully inwardly collapsed condition of the sealing element.

3. An expansion joint cover for bridging the space between adjacent sections of a building on opposite sides of an expansion gap comprising a pair of elongated extruded rigid frame members adapted to be anchored to the respective sections, each of the frame members including a generally vertical wall portion and a multiplicity of longitudinally spaced apart, substantially horizontal plate-like tongues integral with and supported in cantilevered relation by the vertical wall portion at locations spaced from the upper edge of the wall portion and in longitudinal alignment, each tongue being a vestigial segment of a longitudinally continuous flange from which pieces corresponding to the spaces have been removed, the longitudinal spacing between adjacent tongues of each frame member being not less than the widths of the tongues of the other frame member such that in the cover as installed in the expansion gap the tongues of each frame member project into the spaces between the tongues of other frame members and a generally longitudinally continuous bridge is formed by an intervening of end portions of the tongues of each of the frame members between end portions of the tongues of the other along the expansion gap, and wherein each frame member includes a longitudinally continuous flange extending generally inwardly from the vertical wall portion toward the expansion gap and spaced apart from and located above the tongues, the flange defining within the tongues a longitudinally inwardly open cavity, and a resiliently compressible sealing element composed of interconnected walls defining hollow longitudinally elongated cells engaging the vertical wall portions of the respective frame members and supported by the tongues, wherein portions along the edges of the sealing element are received and retained in the respective cavities of the frame members, wherein each frame member includes a longitudinally continuous generally downwardly projecting rib along the free edge of the flange and defining within the vertical wall portion a generally downwardly facing groove, the vertical wall portion includes a generally upwardly facing longitudinally continuous groove extending below the level of the tongues, each frame member including an integral longitudinally extending boss thereon having longitudinally extending openings therein opening to the end of the frame member and defining means for receiving an alignment member at abutting ends of linearly disposed frame members to linearly align the frame members, and the sealing element includes longitudinally continuous upper and lower beads received in the grooves of the frame member for retention of the sealing element in the respective frame members, wherein the sealing element includes a multiplicity of longitudinally continuous side by side hollow cells defined by transversally spaced apart generally vertical wall portions and vertically spaced apart generally transverse wall portions interconnecting the respective top and bottom edges of the vertical wall portions, at least one of the transverse wall portions of each cell having angularly related segments adapted to fold into the space within the cell upon transverse compression of the sealing element when the expansion gap narrows, wherein the transverse dimensional relationships between the cavities of the frame members as installed in the joint and the transverse dimensional relationships between the beads of the sealing element in its relaxed condition are such that the upper transverse wall portions are always under a greater compression or lower tension than are the lower transverse wall portions when the sealing element is in place, thus always to impart a downward force on the center of the sealing element; thereby maintaining the upper transverse wall portions substantially flush with said generally inwardly extending flange portions independent of the relative spacing of the frame members, and including the fully inwardly collapsed condition of the sealing element.

* * * * *